US005635097A

United States Patent [19]

Aiello

[11] Patent Number: 5,635,097

[45] Date of Patent: Jun. 3, 1997

[54] REBAR RETENTION APPARATUS

[75] Inventor: Anthony C. Aiello, Wayne, Ill.

[73] Assignee: Concrete Structures of the Midwest, Inc., Wayne, Ill.

[21] Appl. No.: 388,467

[22] Filed: Feb. 14, 1995

[51] Int. Cl.[6] ..... E04G 17/06

[52] U.S. Cl. ..... 249/38; 249/43; 249/93; 249/94; 249/190; 264/35

[58] Field of Search ..... 249/43, 38, 93, 249/94, 96, 97, 190, 2–4; 264/35

[56] References Cited

U.S. PATENT DOCUMENTS

| | | | |
|---|---|---|---|
| 2,657,447 | 11/1953 | Pellanda, Jr. . | |
| 3,048,911 | 8/1962 | Almon . | |
| 3,060,541 | 10/1962 | Hillberg | 249/190 |
| 3,319,268 | 5/1967 | Blumenkranz . | |
| 3,421,551 | 1/1969 | Currier . | |
| 3,514,070 | 5/1970 | McArdle | 249/40 |
| 3,632,724 | 1/1972 | Hidgeman | 249/40 |
| 3,745,737 | 7/1973 | Keller et al. . | |
| 3,800,486 | 4/1974 | Harvey . | |
| 3,806,080 | 4/1974 | Franklin | 249/40 |
| 3,907,244 | 9/1975 | Abbott | 249/40 |
| 3,926,400 | 12/1975 | Franc . | |
| 3,941,346 | 3/1976 | Franc . | |
| 3,998,424 | 12/1976 | Johnson | 249/40 |
| 4,016,696 | 4/1977 | Mess et al. . | |
| 4,044,091 | 8/1977 | Hurst . | |
| 4,170,248 | 10/1979 | Bennett et al. . | |
| 4,429,886 | 2/1984 | Buttner . | |
| 4,640,490 | 2/1987 | Wilson . | |
| 4,650,149 | 3/1987 | Poulette et al. . | |
| 4,674,255 | 6/1987 | Derome . | |
| 4,726,560 | 2/1988 | Dotson . | |
| 4,754,590 | 7/1988 | Gordon . | |
| 5,190,320 | 3/1993 | Hodges . | |
| 5,309,691 | 5/1994 | Tolliver et al. . | |

*Primary Examiner*—Khanh P. Nguyen
*Attorney, Agent, or Firm*—Niro, Scavone, Haller & Niro

[57] ABSTRACT

A retaining member for retaining spaced rigid members within a concrete matrix. A form for shaping the concrete matrix includes a base, a planar shaping surface for supporting the concrete matrix during its initial setting period, and a supporting member located on the rear side of the shaping surface. The retaining member includes a compressible hollow cylinder, preferably made of a foamed polymeric material. Portions of the retaining member are associated with the form and the supporting member, holding the retaining member in place to retain each rigid member in a parallel position to the other rigid members.

6 Claims, 2 Drawing Sheets

FIG. 1
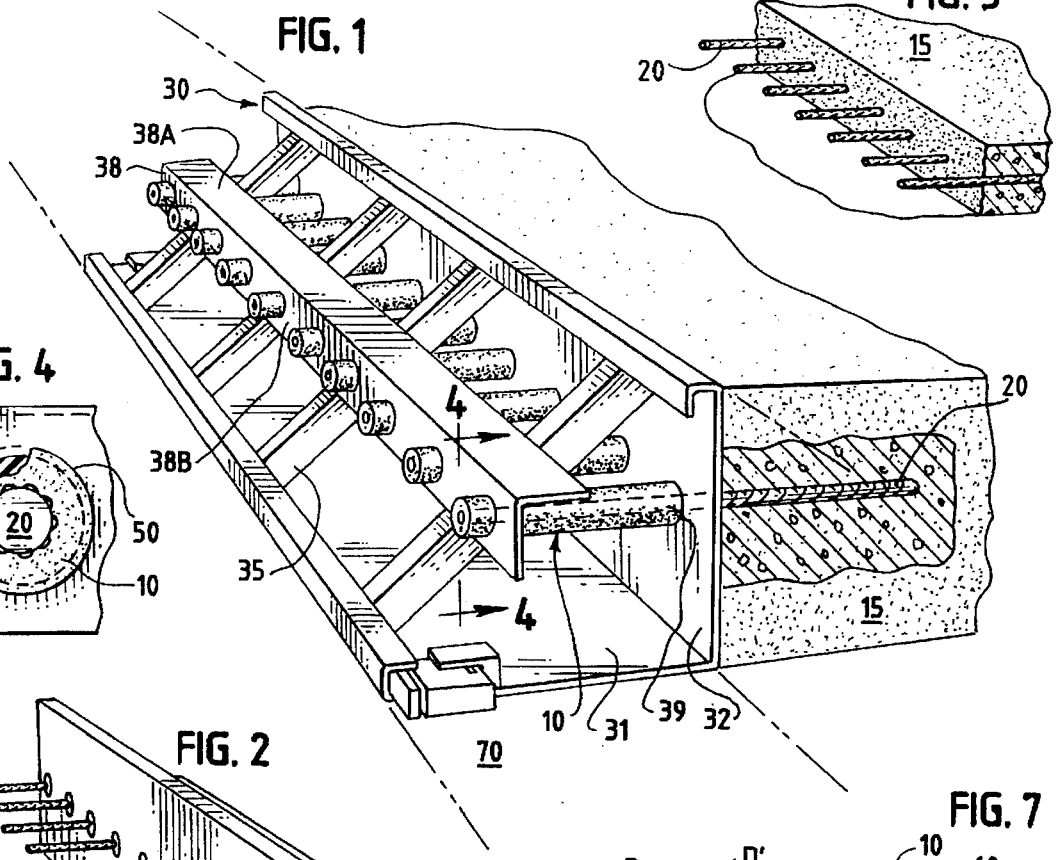
FIG. 5
FIG. 4
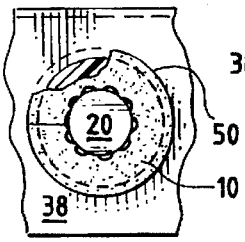
FIG. 2
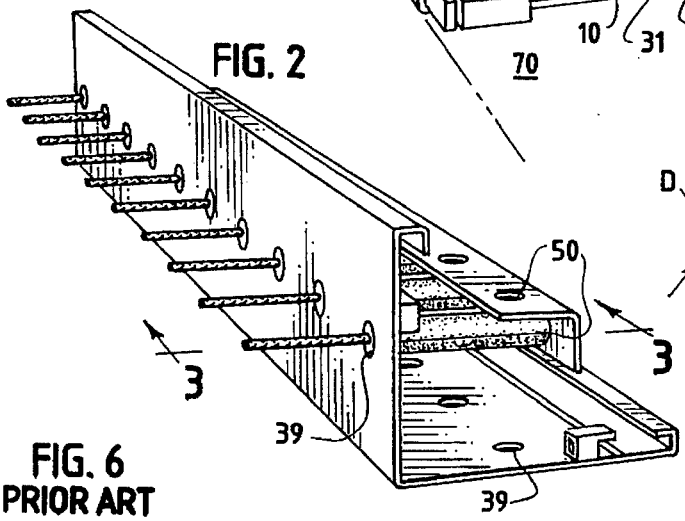
FIG. 7
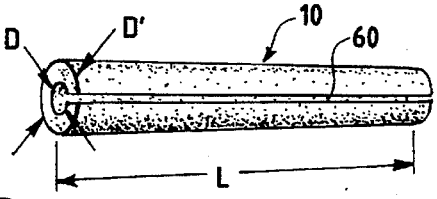
FIG. 6
PRIOR ART
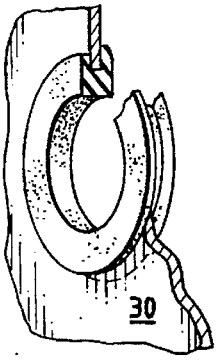
FIG. 3
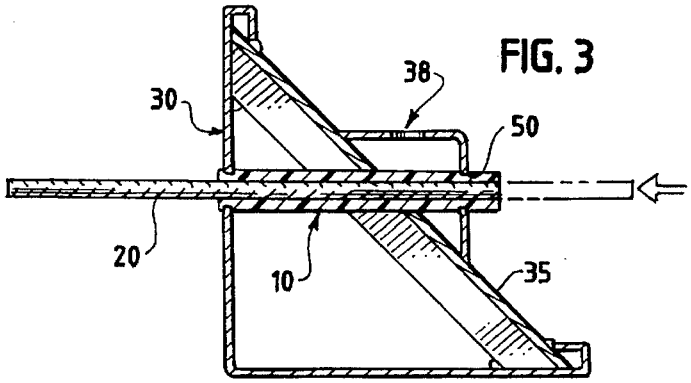

REBAR RETENTION APPARATUS

BACKGROUND OF THE INVENTION

The present invention relates to a rebar retention device used in the construction industry, and to a method for using the device. More specifically, the invention relates to compressible retaining members associated with rigid members which are located within forms used in the placement and curing of concrete.

During the construction of structures utilizing concrete poured in situ, iron or wooden forms are provided and serve as a barrier and mold for the hardening concrete. Typically, cylindrical steel reinforcing bars ("rebar") are located within the concrete matrix and provide tensile strength to the concrete.

In paving operations, concrete roads or airstrips, for example, are constructed using large iron forms to enclose and shape the concrete matrix. Two basic methods have been used in the past to locate and position the rebar within the concrete. In one method, "gang drills," large drilling machines carrying multiple drills whose spacing and depth can be varied, have been used to drill holes at various locations through the still-hardening concrete pavement. Rebar can then be positioned in those holes. Since this drilling is a time-consuming and relatively expensive procedure, it is preferred to place the rebar before the concrete has been poured. In this, more typical, method, the forms themselves are used to support the rebar in position within the hardening concrete. It is this latter, preferred operation which is the subject of this invention.

When placing rebar in a location where wet concrete is to be poured for a paving operation, it is important that the rebar be positioned normal to the length-wise section of the form. As those of skill in the art will recognize, this will permit the rebar to strengthen the pavement in the most effective manner. This placement position is also important during form removal, which is typically accomplished by chaining the forms to a forklift or similar machine and forcing the forms in a horizontal direction to remove them from the concrete and rebar. It can be appreciated that if the rebar is not positioned so that it is nearly precisely normal to the form, this removal process can become much more difficult, since skewed or differently angled rebar will have a greater tendency to resist removal from the form. This will result in increased time and labor spent in "stripping" or removing the forms from the concrete and rebar.

In order to properly position the rebar, the present inventor developed a flexible, annular rubber insert (shown at FIG. 6) which was inserted into spaced holes (e.g., apertures 39 and 50 of FIGS. 1 and 2) associated with the forms. This rubber insert included a recessed ring circumventing the periphery of the insert for engaging the inner surface of the form apertures. The rebar was then placed within the inserts, serving to retain the rebar in place as it was impacted by the concrete mix during pouring. The flexibility of the insert accounted for manufacturing tolerance differences between the rebar and the form apertures, permitting the rebar to be retained in position normal to the form. The use of this insert was a significant improvement over the prior art, since rebar would often be knocked out of position during pouring, decreasing the overall resistance of the concrete to cracking and increasing the difficulty involved in stripping the form.

Despite the advantages these rubber inserts provided over prior art methods of retaining rebar within concrete, there were still disadvantages associated with them. For example, these types of rubber inserts proved to be relatively expensive. This is an important consideration, since in large-scale paving operations thousands of these inserts can be used, and the cost of the rubber inserts tended to require that they be recovered and reused. Further, there were difficulties involved in removing these rubber inserts from the forms. Thus, it was time consuming to individually remove each rubber insert from the forms. A relatively inexpensive rebar retention device which allows the rebar to be properly positioned while facilitating the process of stripping the forms from the concrete and rebar is needed.

SUMMARY OF THE INVENTION

The present invention preserves the known advantages of prior art rebar retaining apparatus, and methods for using that apparatus. In addition, it provides new advantages not found in currently available apparatus and methods for using that apparatus, overcomes many of the disadvantages of such currently available devices, including those discussed above.

The invention is generally directed to an apparatus for retaining rigid members in proper orientation and position within a form. More specifically, the invention is directed to a compressible, retaining member for retaining a plurality of spaced rigid members in a parallel fashion within a concrete matrix. The retaining member can be radially and axially compressed about the rigid member to facilitate the proper positioning of the rigid member with respect to the form. In one preferred embodiment, the retaining member is a generally cylindrical hollow tube which includes a longitudinal slot running the length of the tube. In a particularly preferred embodiment, the retaining member is fabricated from a foamed, polymeric material such as styrofoam.

In another embodiment of the present invention, an apparatus is provided for forming a concrete matrix, and includes a form for shaping the concrete matrix. The form includes a base and a planar shaping surface for supporting the concrete matrix. A supporting member is also associated with the form and is located on the side of the form opposite the shaping surface. A plurality of spaced rigid members also form part of the apparatus. A generally cylindrical and compressible retaining member is associated with each of the rigid members, and retains the rigid members in a position substantially normal to the shaping surface.

In another preferred embodiment of the invention, a method is disclosed for forming a concrete matrix containing a plurality of spaced rigid members positioned parallel to each other. The method includes the initial step of positioning a form for shaping and supporting the periphery of a concrete matrix. The form has associated with it a supporting member extending rearward of the form. Both the form and the supporting member include spaced apertures. A second step of the method involves enclosing a portion of each rigid member with a generally cylindrical, compressible retaining member. A third step is retaining the rigid members in parallel position to each other by inserting one end of the retaining members through spaced apertures of the form, and the opposing end of the retaining members within corresponding spaced apertures of the supporting member. Finally, concrete is poured on the forward side of the form, and the concrete is permitted to partially harden. In an alternative further step, a petroleum-based solvent can be sprayed on the retaining member, partially degradating the retaining member and facilitating the removal of the forms from the concrete matrix.

BRIEF DESCRIPTION OF THE DRAWINGS

The novel features of the invention are set forth in the appended claims. The invention itself, however, together with further objects and attendant advantages thereof, will be best understood by reference to the following description taken in connection with the accompanying drawings in which:

FIG. 1 is a partial side perspective view illustrating one embodiment of the present invention in its working environment;

FIG. 2 is a view similar to FIG. 1 showing the rear side of the invention within a portion of its working environment;

FIG. 3 is a side cross-sectional view taken along section lines 3—3 of FIG. 2;

FIG. 4 is a planar view of the present invention in its working environment, taken along section line 4—4 of FIG. 1;

FIG. 5 is a partial side perspective view of a portion of the working environment of the present invention;

FIG. 6 is a partial side perspective and partial cross-sectional view of a prior art insert located within a form aperture;

FIG. 7 is a side perspective view of the retaining member of the present invention, with length "L," inner diameter "D" and outer diameter "D'"

DETAILED DESCRIPTION OF THE PREFERRED EMBODIMENTS

Figure 8:
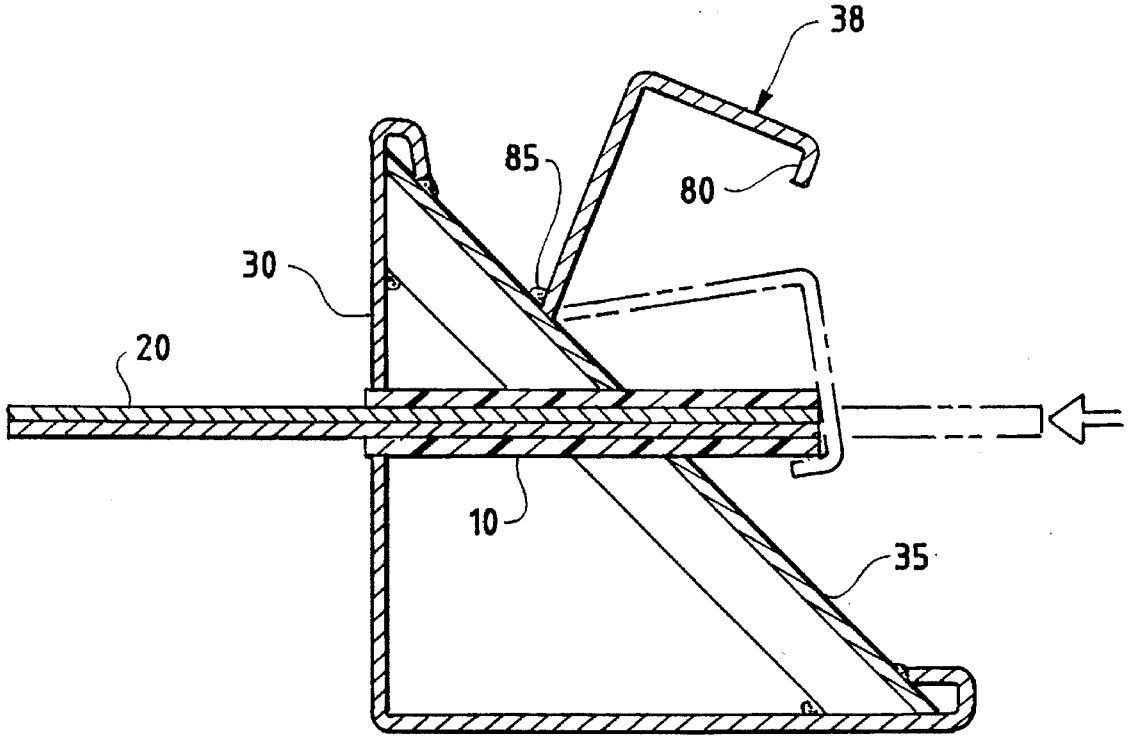
FIG. 8 is side cross-sectional view similar to the view taken along section lines 3—3 of FIG. 2 of an alternative embodiment of the present invention.

With reference to the drawings and particularly FIGS. 1 and 7, one preferred embodiment of the retaining member of the present invention, designated generally as 10, is shown. Retaining member 10 is shown at FIG. 1 within its working environment, which includes iron form 30, concrete pavement 15, and rebar 20. While other types of forms can be used, form 30 depicted in the drawings is of a type typically used in paving operations. Form 30 includes horizontal base 31, vertical shaping surface or platform 32, diagonal struts 35, and spaced form apertures 39. Base 31 lies flat on the ground, which is designated generally as 70. Form 30 also includes a horizontal, angular supporting member 38, which includes a horizontal leg 38A and a vertical leg 38B. Vertical leg 38B includes spaced apertures 50. Those with experience in the use of these forms will understand that form 30 can be rotated so that shaping surface 32 can be placed on the ground to serve as a base, with base 31 then serving as the shaping surface.

Referring now to FIG. 3, rebar 20 is supported in a horizontal orientation normal to vertical shaping surface 32. ("Vertical" as used here means in a direction normal to ground 70). This is accomplished through the use of retaining member 10 of the present invention, as follows. First, rebar 20 is inserted into and through retaining member 10. Next, retaining member 10, now housing a portion of rebar 20, is inserted through form aperture 39, and then inserted through aperture 50, so that it lies rearward of shaping surface 32. ("Forward," as used in this application, means in a horizontal direction toward concrete pavement 15 from form 30). In this manner, opposite ends of retaining member 10 are positioned within apertures 39 and 50, respectively, securing rebar 20 in a normal position relative to base 31. Alternatively, the opposing ends of retaining member 10 can first be inserted within apertures 39 and 50. Then, rebar 20 can be inserted through retaining member 10.

As seen in FIG. 7, retaining member 10 includes slot 60, formed by the removal of material along a longitudinal portion of retaining member 10. Slot 60 facilitates the ability of retaining member 10 to expand radially to accommodate the insertion of rebar 20. Slot 60 also facilitates the ability of connected member 10 to be compressed about rebar 20.

Referring now to FIGS. 1 and 7, after rebar 20 is inserted into retaining member 10, retaining member 10 can be compressed or squeezed about rebar 20 to fit within apertures 39 and 50. Due to the foamed polymeric material which is preferably used, described below, this compression includes both a "radial" compression, in which the width of slot 60 is decreased, and an "axial" compression, in which apertures 39 and 50 exert a compaction force serving to decrease outer diameter D' of retaining member 10. Each of these compressive forces serve to more securely position rebar 20 within retaining member 10. Preferably, rebar 20 has a slightly greater diameter than the inside diameter "D" of retaining member 10 to prevent the rebar dowels from sagging.

While retaining member 10 can be made of a variety of compressible materials, including, for example, a variety of rubbers or polymeric materials such as polyethylene, polyurethane or polystyrene, retaining member 10 is preferably fabricated from a foamed polymeric material such as styrofoam.

Styrofoam is a particularly preferred embodiment of the present invention for several reasons. Styrofoam has been found to function well as a retaining member due to its compressibility, which facilitates its positioning within the forms. Yet styrofoam has also been found to have sufficient strength to properly retain the rebar in position. Also, styrofoam retaining members can be fabricated at sufficiently low manufacturing costs that they can be discarded after use. It has also been found that styrofoam will degradate or "melt" when sprayed with a petroleum-based solvent such as gasoline or kerosene, allowing the forms to be easily stripped.

It will be understood that other embodiments of form 30 or supporting member 38 can be used. For example, instead of being fixably connected to struts 35, supporting member 38 could be pivotally connected at pivot point 85, as shown in FIG. 8. A toggle switch or other connecting element could also be used, so that supporting member 38 could be placed in an "up" position when not associated with retaining member 10, and a "down" position when placed in a position for supporting retaining member 10. Further, instead of using spaced apertures 50 on supporting member 38 for supporting retaining member 10, supporting member 38 can include overhanging edge or lip 80 for doing so, as shown in FIG. 8. Those of skill in the art will appreciate that supporting member 38 could consist of these or alternative embodiments.

The preferred embodiment of the present invention described here is directed to the specific application of a concrete paving operation. However, those of skill in the art will appreciate that the present invention can be adapated for other applications in the construction industry in which structures are erected using poured concrete.

Of course, it should be understood that various changes, modifications and equivalents to the disclosed preferred embodiments will be apparent to those skilled in the art. Such changes, modifications and equivalents can be made without departing from the spirit and scope of the present invention and without diminishing its attendant advantages. Therefore, the scope of the invention is recited by the following claims, which are intended to include such changes, modifications and equivalents.

What is claimed is:

1. An apparatus for forming a concrete matrix, comprising:

a form for shaping the concrete matrix, the form including a horizontal base and a vertically extending platform having an outer surface and an inner shaping surface adapted to support the concrete matrix, the platform including a plurality of a first set of spaced apertures;

a supporting member connected to the form and located on the side of the platform adjacent the outer surface, the supporting member including a plurality of a second set of spaced apertures aligned with the first set of spaced apertures;

a plurality of spaced rigid members, each of the rigid members passing through one of each of the first and second sets of the spaced apertures; and a plurality of generally cylindrical and compressible retaining members, each of the retaining members having opposed ends and being adapted to partially enclose a rigid member, and each of the opposed ends being insertable through one of each of the first and second sets of the spaced apertures, the retaining members thereby being adapted to retain each of the rigid members in a generally fixed position relative to the platform.

2. The device for forming a concrete matrix of claim 1, wherein the retaining members are formed from a foamed polymeric material.

3. The device for forming a concrete matrix of claim 1, wherein the retaining members are made of styrofoam.

4. The device for forming a concrete matrix of claim 1, wherein insertion of the compressible retaining members into the first and second sets of spaced apertures and about the rigid members causes the compressible retaining members to be radially and axially compressed about the rigid members, thereby facilitating the proper positioning of the rigid members with respect to the form.

5. The device for forming a concrete matrix of claim 1, wherein the supporting member is pivotally connected to the form.

6. The device for forming a concrete matrix of claim 1, wherein the supporting member facilitates the retention of the retaining members in position.

* * * * *